United States Patent [19]

Radstake et al.

[11] 4,021,309

[45] May 3, 1977

[54] AUTOMATIC COKE OVEN PLANT WITH MEANS TO INSURE SUFFICIENT COKING

[75] Inventors: Herman Radstake, Uitgeest; Gerrit De Jong, Velsen-Noord; Josephus Hendrikus Maria van der Velden, Aerdenhout, all of Netherlands

[73] Assignee: Hoogovens Ijmuiden B.V., Ijmuiden, Netherlands

[22] Filed: Oct. 21, 1974

[21] Appl. No.: 516,493

Related U.S. Application Data

[63] Continuation of Ser. No. 365,283, May 30, 1973, abandoned.

[30] Foreign Application Priority Data

May 30, 1972 Netherlands ..... 7207307

[52] U.S. Cl. ..... 202/227; 201/1; 201/39; 201/40; 202/248; 202/262; 202/261

[51] Int. Cl.[2] ..... C01B 35/00; C01B 47/00

[58] Field of Search ..... 201/1, 39, 40, 41; 202/262, 270, 261, 263, 227, 228, 229

[56] References Cited

UNITED STATES PATENTS

| | | | |
|---|---|---|---|
| 3,464,894 | 9/1969 | Tatterson | 202/262 |
| 3,506,542 | 4/1970 | Kulakow | 201/1 |
| 3,607,660 | 9/1971 | Kumper | 201/1 |
| 3,897,311 | 7/1975 | Krenke | 201/1 |

FOREIGN PATENTS OR APPLICATIONS

| | | | |
|---|---|---|---|
| 7,009,106 | 12/1970 | Netherlands | 201/1 |

*Primary Examiner*—Stephen J. Emery
*Attorney, Agent, or Firm*—Hall & Houghton

[57] ABSTRACT

A method and apparatus for the production of coke from coal by a dry distillation operation wherein the coking plant is provided with a computer unit that receives signals from the coal leveling mechanism, the door mechanism, the quenching car mechanism, and a signal value for the time required to achieve the coking of the coal. The computer prevents the opening of any given coking chamber until the minimum coking time has lapsed and the opening of the chamber and discharging and quenching of the coke is correlated to the actual operating conditions rushing at that time. If desired, the charging and emptying operations may be carried out on a completely automatic basis.

4 Claims, 4 Drawing Figures

AUTOMATIC COKE OVEN PLANT WITH MEANS TO INSURE SUFFICIENT COKING

This is a continuation of application Ser. No. 365,283, filed May 30, 1973, now abandoned.

This invention relates to a method for operating a coke oven plant in which coal is made into coke by dry distillation.

Such coke oven plants are generally known and usually contain a number of coke oven batteries arranged in a row and moreover at least coal supply means, a coal charging car, a pusher machine, a door machine, a coke quenching car, a quenching tower and a quenching slope. The battery consists of a number of oven chambers of narrow width, with an internal volume of e.g. 15–40 $m^3$, between which heating chambers for the heating gas are provided and below which the regenerators for combustion air and heating gas are arranged. The ovens are usually gas-fired. The regenerator principle makes it necessary to guide the air and the combustion gases and in many cases the heating gas along another path through the regenerator chambers after each half hour, for which purpose all valves are operated in combination simultaneously for each battery by a central switching mechanism.

The charging car movable on top of the battery is filled from the coal supply means. The coal is dumped from the charging car into a chamber which has just been emptied, e.g. through four charging holes, and in the chamber to be filled the doors are closed. By means of a planing rod mounted on the pushing machine the coal quantity charged into the chamber is thereupon flattened out at its top surface, so that the escaping gases easily find their way along the top of the coal charge through the so-called ascension pipe or gas off-take pipe to the gas collecting manifold.

Starting from the heated side walls of the coke oven chambers heated from the heating chambers the coke or distillation begins, the temperature in the oven chamber rising to about 1000° C. By this heating process in a condition sealed from the ambient atmosphere the volatile constituents escape from the coals and the fine coal particles are baked together to form coke. The so-called coking times or carbonizing times may vary considerably and will, depending on the characteristics of the coal to be coked and the conditions of the distillation, vary usually between 12 and 20 hours. The chambers are emptied by the pushing machine according to a predetermined program. For emptying, the doors at the so-called coke-side and the so-called machine-side of the coking chambers are removed, after which the glowing coke is pushed out by a pusher head of large area on a pusher rod of the pushing machine so that the coke moves through the coke guiding frame of the door machine into the quenching car which is slowly moved along the battery. Thereupon this car is immediately moved to the quenching tower, where the coke is rapidly quenched with water. After dripping out the quenching car is moved to the quenching slope and the quenched coke is thereupon dumped onto this slope and is therefrom moved by suitable conveying means to suitable stations for storing or use.

The several actions to be taken for the several movements to be made for the normal cycle of a coke oven plant are mainly exerted by the operating personnel by using optical and acoustic signals about positions and conditions of doors, valves, covers and the like and also on the basis of lists giving a program for charging and emptying certain oven chambers in the desired sequence. The literature already gives quite a number of proposals to facilitate the operation of coke oven plants and to exclude human mistakes as far as possible. An example thereof is the so-called automatic locking system for emptying the oven chambers which secures that the pushing machine, the door machine and the quenching car will always be in the correct position when a certain oven chamber is emptied. It is thus only possible to push the coke from an oven chamber if both doors of the oven chamber have been removed and if the pushing machine, the guide frame for the issuing coke on the door machine and the quenching car are positioned in line with the oven chamber to be emptied. It would be of great importance for decreasing air pollution if there would be an automatic control of the coking time, which would avoid that an oven chamber is emptied before the coal therein has been sufficiently coked.

An object of the present invention is to obtain a method for operating a coke oven plant of the type as described above and in such a way that this is programmed and effected automatically.

Another object of the invention is to obtain a device for realizing such a method, provided with means for avoiding human mistakes and with members reacting to the different phases of the cycle of operations.

In view of the above a method according to the invention is characterized in that a program for emptying is used according to which the pushing machine, the door machine and the quenching car move along the ovens, which program only allows the removal of the doors from an oven chamber if a predetermined and preadjusted coking time has lapsed, after which the pushing of the oven chamber takes place, which is done under control of a computer in which not only the emptying program but also data about the coking time of the relating furnace chamber have been fed. The emptying program is not fully fixed, but is adapted by the computer to circumstances during operation.

The correct moment of beginning of the coking time can be fixed in the computer by a signal deriving from a contact on the planing mechanism, which signal is generated during the planing operation, or by a signal derived from a contact on the charging mechanism which signal is generated at the end of the charging operation. Said last solution, however, requires a possibility of communication with the charging car and the first solution is more simple to realize, because the planing mechanism is mounted on the pushing machine and because there is already communication from this machine in view of the necessity of locking the pushing mechanism. On the basis of data about the composition of the coal, the density thereof and the quantity of heat which has to be supplied to the heating chambers, the minimum and maximum coking times are determined and this information is fed to the computer.

By using this invention a number of advantages is obtainable. The possibility that coke is removed from an oven chamber before being sufficiently coked has been reduced to substantially zero. The product obtained is is more homogeneous in character and composition. Moreover, air pollution is counteracted because coke not yet sufficiently coked gives off much gas and coal dust. For an optimum operation of a coke oven plant it is very important that the coking times are maintained as much as possible, which is obtained in a very simple way by using the invention because in the computer the minimum required coking time is fed as a determining and limiting factor for the operation. The time interval during which the oven chamber is in a position with open doors should be reduced to a minimum.

The invention will now be explained in more detail with reference to the enclosed drawings. In said drawings.

Figure 1:
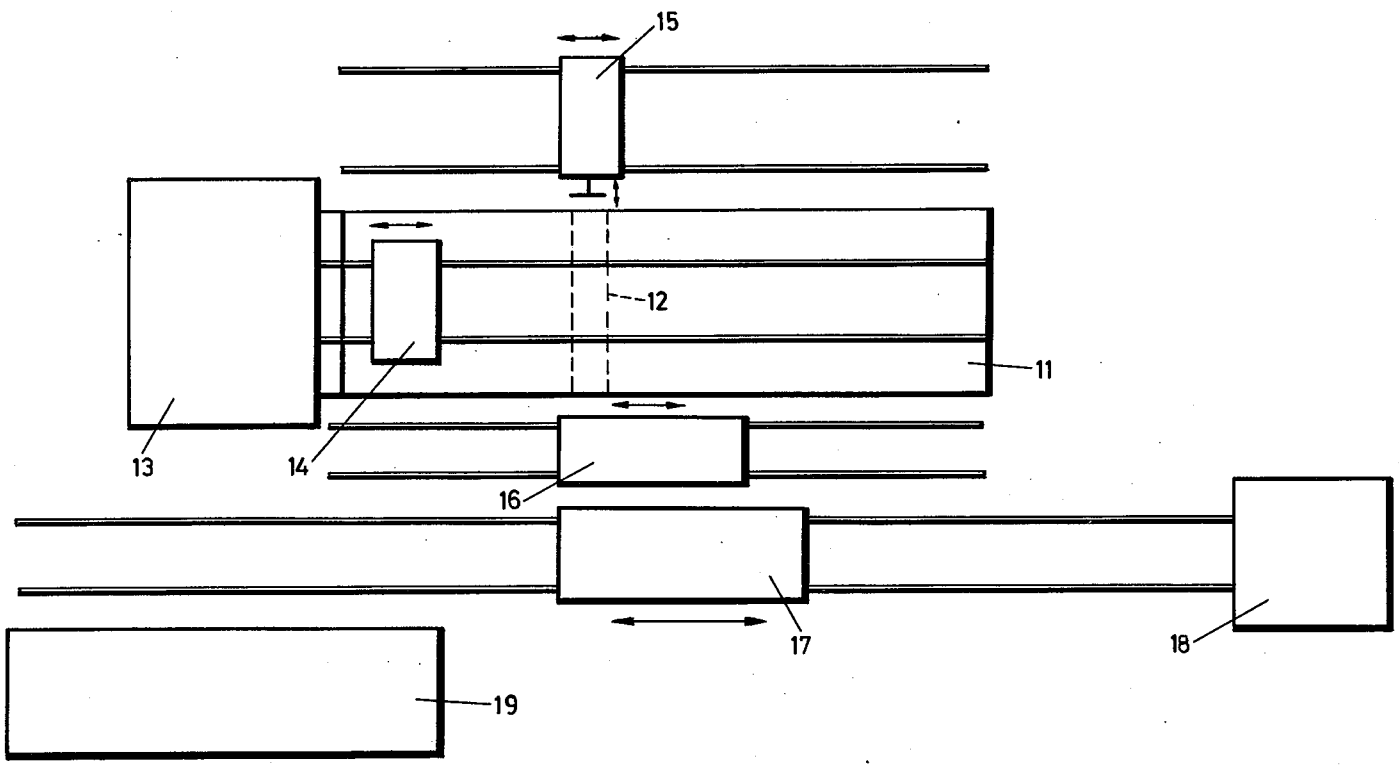
FIG. 1 is a diagrammatic top view of part of a coke oven plant.

FIG. 1 shows diagrammatically in view from above the usual lay-out of a coke oven plant consisting of a battery 11 of oven chambers (among others 12) and heating chambers between the oven chambers, a coal hopper 13, a charging car 14, a pushing machine 15, a door machine 16, a quenching car 17, a quenching tower 18 and a quenching slope 19, which parts cooperate mutually in the manner as described before.

Figure 2:
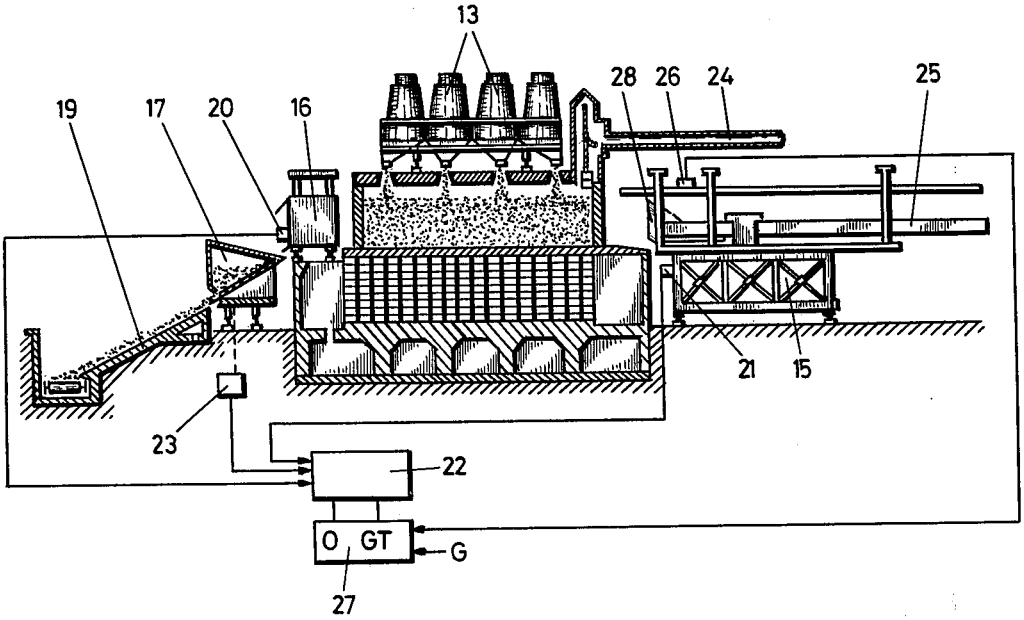
FIG. 2 is a transverse vertical section of a coke oven plant showing mutual signal line connections between parts.

As appears from FIG. 2, which is a transverse vertial section through one of the oven chambers and surrounding parts, an observing member 20 is mounted on the door removing machine 16 and an observing member 21 is mounted on the pushing machine 15, both connected through a signal line to a member 22 so that the presence of both machines 15 and 16 can be reported to said member 22 for allowing the so-called mutual locking. The position of the quenching car 17 is derived from said car with the aid of an impulse counter 23 and this position is thus also reported through a signal line to member 22.

The quenching car 17 is moved over rails and is e.g. driven by a winch not shown. When taking up coke from an oven chamber this car is moved slowly (so-called creeping) and to and from the quenching tower 18 this car is driven at normal speed.

The sequence of pushing and thus emptying of the different oven chambers in normal operation takes place on the basis of a sequence diagram made while taking into account the pressure which is exerted on the walls of the adjacent heating chambers by the swelling of the coke towards the end of the coking time in the oven chamber. This implies that it is not allowed to empty an oven chamber if an adjacent oven chamber is empty. Moreover, it is in the scope of the invention not allowed to empty an oven chamber before lapse of the minimum coking time. At the end of the coking time an oven chamber is disconnected from the gas collecting manifold (24 in FIG. 2) and is put into communication with the ambient atmosphere. Moreover, the so-called ascension or gas pipe is cleaned after this disconnection.

After this disconnection the doors are opened, the coke is pushed out of the oven chamber and the doors are closed again. At the same time another oven chamber, several oven widths distant from the chamber thus emptied, is charged with coal.

The pushing machine 15 carries a planing rod 25 to level the top surface of coal charged into the oven chamber. On the planing mechanism there is a contact switch 26 which, when the planing mechanism is put into operation, gives a signal through a signal line to a computer 27 which signal indicates that the coking time has begun. This coking time is determined for each oven chamber on the basis of a.o. the kind of coal charged therein, the density of this coal and the quantity of heat, which is fed to the heating chambers of the concerning battery. This coking time G is fed as a second input value of the computer 27, which through a control member secures that the locking of the doors is only freed after lapse of the calculated minimum coking time.

The computer 27 can be provided with an output member not shown, by which the emptying program which at a certain moment is the optimum program is made visible for the operating personnel. This output member may be a connection to a telex apparatus or a television screen.

The emptying program is not a fixed program, but is each time adjusted by the computer during operation on the basis of data derived from the operation, such as disturbances thereof, damages of parts, other coal compositions, a change in the heat quantity supply to the heating chambers etc.

Figure 3:
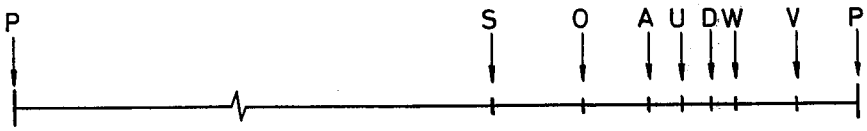
FIG. 3 is a time diagram for the operation.
Figure 4:
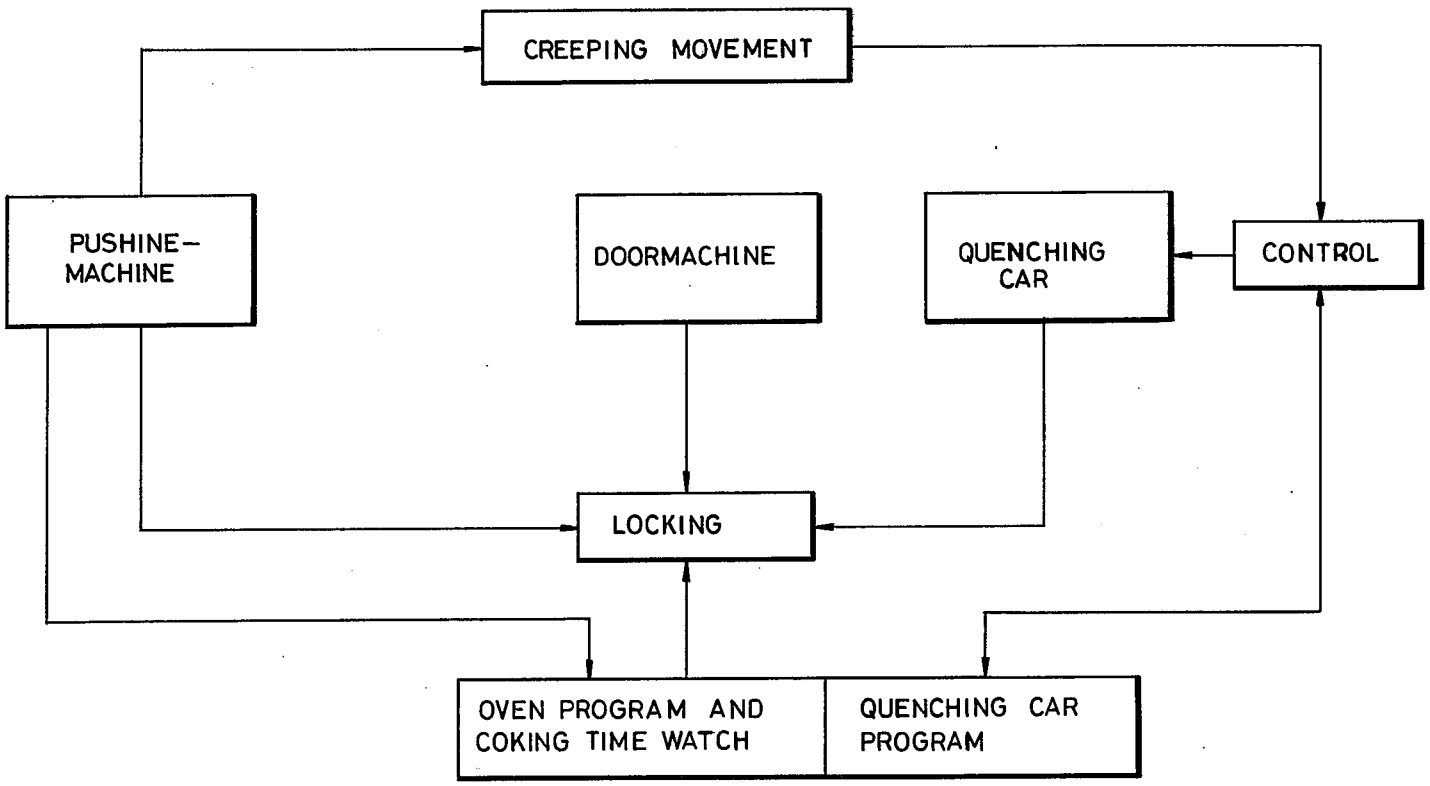
FIG. 4 is a diagram of the actions which are controlled according to the invention.

In FIG. 3 an oven time diagram is given, in which along the horizontal line a time is given progressing from left to right. This line covers an entire period between two subsequent planing actions P—P for one single oven chamber. The coking time for the oven chamber is indicated by the time interval P—O. Before O no unlocking of the doors etc. is made possible. So, if the computer 27 at moment S has already selected the said oven chamber to be emptied, it should be waited until the end of said coking time, so up to moment O, before member 22 will operate or allow the unlocking means for allowing to take away the doors. Then the doors are removed and thereupon, at moment A, it is checked whether not only the pushing machine 15 and the door machine 16, but also the quenching car 17 are in the correct position for emptying the concerning chamber and whether all preparatory operations on all machines have been made. This does not mean of course that the pushing machine 15 and the door machine 16 are only put into this position at moment A. Such positioning may be done earlier, but a A all the checking of positions of preparatory actions should be made. If everything is correct in this respect, the emptying of the oven chamber by pushing the coke out of it with the aid of pusher head 28 on the pushing machine 15 may take place at moment U. After emptying and return of pusher head 28 the doors are closed again at moment D and, after waiting for a short period, beginning at W, the recharging of the furnace chamber from the charging car 14 will commence at moment V.

During charging, the planing rod 25 will level out the coal in the chamber at moment P, which also marks the beginning of a new coking period of the new charge.

Starting from an existing system of mutual locking of pushing machine, door machine and quenching car for a same oven chamber, in which this oven chamber has been appointed as the correct one to be processed by such machines from a predetermined sequence program, this selection is according to the invention generated by a programmed computer 27.

If again one of the oven chambers is appointed to be processed by the locking system and this is combined with the prevention of operations for emptying on the concerning oven chamber until a certain time interval has passed for the coal charge to be present in said oven chamber, it is thus obtained that for each oven chamber a minimum time of presence of the coal therein and thus coking time is obtained.

A determining of the moment of beginning of this coking time is derived from the moment of charging of this furnace chamber by the charging car or by the moment of planing of this furnace by a planing rod on the pushing machine. From this information the computer 27 calculates the earliest possible moment of emptying said chamber again depending upon the coking time which is also influenced by the quantity of heat supplied to the oven battery.

Moreover, the computer 27 should be programmed in such a way that it also gives the possibility, if disturbances in the emptying program occur, e.g. as a result of defects of an oven chamber, that the system is returned to the optimum rhythm taking into account swelling of the coal and the question which oven chambers are full, and the maximum time of stay of the coal in the oven chamber.

With the aid of the computer 27 it is moreover possible to obtain a completely automatic control of pushing machine, door machine, charging system and quenching system.

We claim:

1. In a coke oven plant for automatically producing coke from coal by a dry distillation operation including a number of coke oven batteries in a row which have alternating coking chambers and heating chambers, a coal supply means, coal charging means, a pushing machine, a door machine, a quenching car, a quenching tower, and a quenching slope, the improvement comprising first signal means operatively associated with the pushing machine for generating a signal upon movement of the pushing machine, door control means operatively associated with the door machine, second signal means operatively associated with the door control means for generating a signal to actuate the door control means for controlling the movement of the door machine to automatically lock the door, quenching car control means for controlling the movement of the quenching car, third signal means operatively associated with the car control means for generating a signal to actuate the car control means for controlling the movement of the quenching car, computer means connected in circuitry with the first signal means generated by movement of the pushing machine, the second signal means for actuating the door control means, and the third signal means for actuating the quenching car control means, and means for feeding predetermined minimum and maximum coking time valves as in-put signals to the computer means, said minimum and maximum coking time values being determined on the basis of the composition of the coal, the density thereof, and the quantity of heat to be supplied to the heating chamber, said door control means and quenching car control means being responsive to computer generated output signals for controlling the actuation of the door machine and the movement of the quenching car to insure that the coal will be sufficiently coked.

2. In a coke oven plant in accordance with claim 1, wherein additional signal means are provided for generating a signal upon a change of conditions during the operation of the coke oven plant, said additional signal means being operatively connected to said computer means whereby upon a generation of such signal, means responsive to said computer means will vary the movement of the pushing machine.

3. In a coke oven plant in accordance with claim 1, wherein the pushing machine further includes coal surface planing means and a signal generating contact member, said contact operatively associated with said planing means and operatively connected to an in-put side of the computer means to feed thereinto the signal generated by the contact member by the movement of the coal surface planing means to denote the beginning of the coking time.

4. In a coke oven plant in accordance with claim 1, wherein the coal charging mechanism further includes a signal generating contact member operatively connected to the in-put side of the computer means for generating a signal to be fed to said computer means at the completion of the charging operation to denote the beginning of the coking time.

* * * * *